United States Patent [19]

Green

[11] Patent Number: 5,013,190

[45] Date of Patent: May 7, 1991

[54] DEVICES FOR LIFTING AND SUPPORTING A STRUCTURE AND METHOD

[76] Inventor: Paul W. Green, 724 Lariat, Mustang, Okla. 73064

[21] Appl. No.: 480,421

[22] Filed: Feb. 15, 1990

[51] Int. Cl.[5] ..... E02D 5/00

[52] U.S. Cl. ..... 405/230; 405/229; 254/29 R

[58] Field of Search ..... 405/230, 229, 232, 303; 254/95, 106, 107, 29 R

[56] References Cited

U.S. PATENT DOCUMENTS

| | | | |
|---|---|---|---|
| 3,902,326 | 9/1975 | Langenbach | 405/229 X |
| 4,708,528 | 11/1987 | Rippe | 405/230 |
| 4,765,777 | 8/1988 | Gregory | 405/230 |
| 4,854,782 | 8/1989 | May | 405/230 |
| 4,911,580 | 3/1990 | Gregory et al. | 405/229 X |

*Primary Examiner*—Dennis L. Taylor

*Attorney, Agent, or Firm*—Dunlap, Codding, Peterson & Lee

[57] ABSTRACT

Apparatuses for lifting and supporting a structure comprising a support collar disposable on a support shaft, a jackstand with a support ledge disposable under the structure, and a lifting head for use with a support collar. A method for using the apparatuses comprising disposing a portion of the jackstand under the structure, driving the support shaft with a jack supported on the jackstand, and removing the jackstand. A support collar is disposed on the support shaft, and the structure lifted with a lifting head device secured to the support collar. The collar is secured to the shaft.

6 Claims, 4 Drawing Sheets

DEVICES FOR LIFTING AND SUPPORTING A STRUCTURE AND METHOD

FIELD OF THE INVENTION

The present invention generally relates to devices and methods for lifting and supporting a structure such as a building, and, more particularly, methods and devices used in conjunction with a support shaft driven into the ground.

SUMMARY OF THE INVENTION

There have been many devices used to support structures such as houses and buildings with varying degrees of success and longevity. One method to lift and support structures is to secure a jackstand to the structure, to support a jack on the jackstand and drive a support shaft into the ground. The jackstand generally comprised a support collar and an upright portion: the support collar comprised a support ledge disposable under the structure which was removable from the upright portion which supported the jack. Once the support shaft was driven into the ground, the upright portion of the jackstand was removed leaving the support collar in place which had been secured to the structure during the operation of the jack. The support collar was then lifted to the desired elevation with a lifting jack, which lifted the structure, and the support collar then secured to the support shaft.

This method of securing the support collar (as a part of the jackstand) to the structure during the driving of the support shaft can weaken the contact between the support collar and the structure, and/or put added stress on the support collar which can result in an inferior support for the structure, especially over a period of time. The present invention utilizes a separate jackstand and support collar to provide for an improved support system.

The present invention comprises a support collar, a lifting head, a jackstand and combinations thereof for use with a support shaft for supporting a structure. The support collar comprises a tubular section telescopable over and securable to the upper end portion of a support shaft, a support member secured to the tubular section which is disposable under the structure, and a strut secured to about the middle of the support member and secured to the tubular section. The lifting head, for use with a support collar having a lifting head stand secured to the upper end thereof, comprises a housing capable of supporting a lifting jack, and means for securing the lifting head to the lifting head stand without bolts. The jackstand is for use with a jack which drives a support shaft into the ground. The jackstand comprises a frame removably securable to the structure, means for supporting the jack on the frame, and a ledge portion, permanently secured to the frame which is disposable under the structure.

Methods of the present invention include a method to lift and support a structure on a support shaft comprising driving the support shaft into the ground, disposing a support collar on the upper end portion of the support shaft after the shaft has been driven into the ground, securing the support collar to the structure, lifting the support collar thereby lifting the structure, and securing the support collar to the support shaft. This method may also be used when the support shaft is already disposed in the ground.

DETAILED DESCRIPTION OF THE PREFERRED EMBODIMENTS

Figure 1:
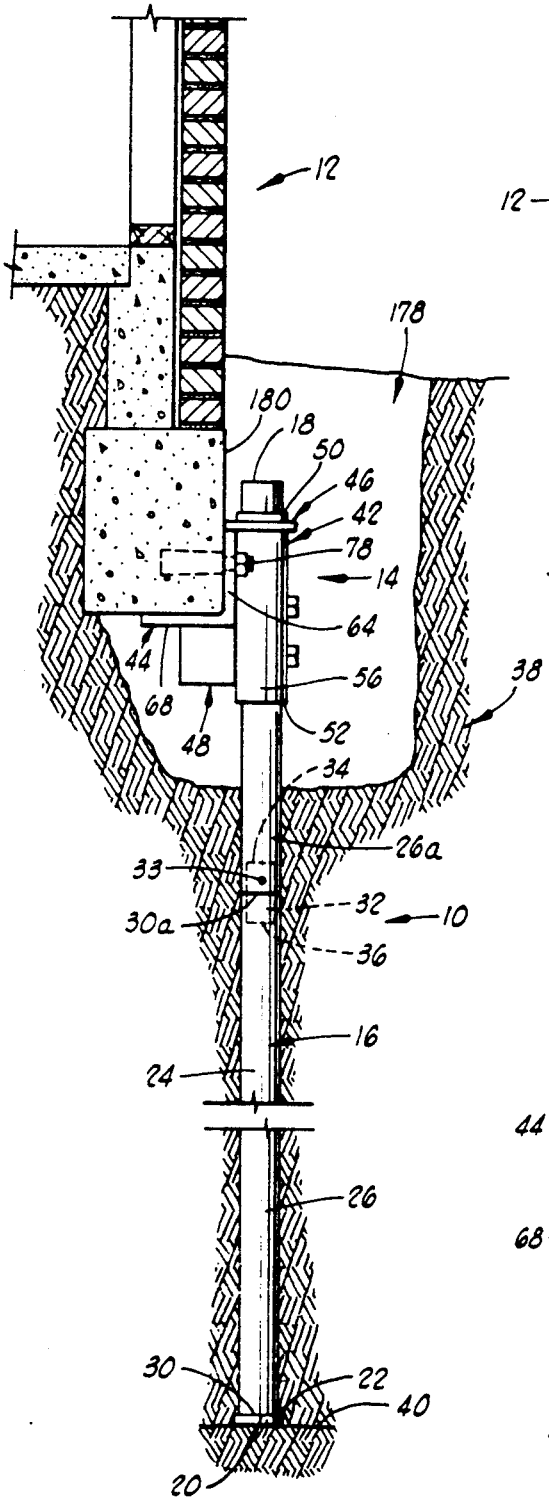
FIG. 1 shows a side elevational view of a support collar secured to a support shaft and a structure, constructed in accordance with the present invention.

Referring to the drawings in detail, and particularly to FIG. 1, reference character 10, generally designates a support apparatus constructed in accordance with the present invention. The support apparatus is secured to a structure, generally designated by the numeral 12. The support apparatus 10 comprises a support collar, generally designated by the numeral 14, and a support shaft, generally designated by the numeral 16.

The support shaft 16 comprises an upper end 18 and a lower end 20, and is circular in cross-section. The lower end 20 is preferably secured to a friction collar 22 which is slightly larger than the outer periphery 24 of the support shaft 16.

The support shaft 16 comprises at least one section 26, and preferably a plurality of sections 26 and **26*a* secured together. Each section 26 and 26*a* comprises an upper end 28 and a lower end 30. The sections 26 and 26*a* are secured together. A preferred manner of securing the sections 26 and 26*a* together is to secure couplers 32 and 32*a* respectively into the upper ends 28 and 28*a* of the sections 26 and 26*a***.

The couplers 32 and **32*a* are preferably short sections of tubing, with an outer diameter slightly smaller than the inner diameter of the sections 26 and 26*a*. Each coupler 32 comprises an upper end 34 and a lower end 36. Each lower end 36 of each coupler 32 and 32*a* is secured, preferably by welding, respectively in the upper ends 28 and 28*a* of the sections 26 and 26*a* such that a portion of the couplers 32 and 32*a*** extends upwardly therefrom.

The lower end **30*a* of section 26*a* (without a coupler), frictionally receives the coupler upper end 34 therein and rests on the upper end 28 of section 26. The coupler 32 may be spot welded 33 to the section 26***a*.

This process may be repeated with successive sections (not shown). The number of sections 26 and 26*a* used will depend upon how far into the ground 38 the support shaft 16 must be driven in order to hit the load strata 4 which is generally the distance the support shaft 16 should be driven in order to support the structure 12.

Figure 2:
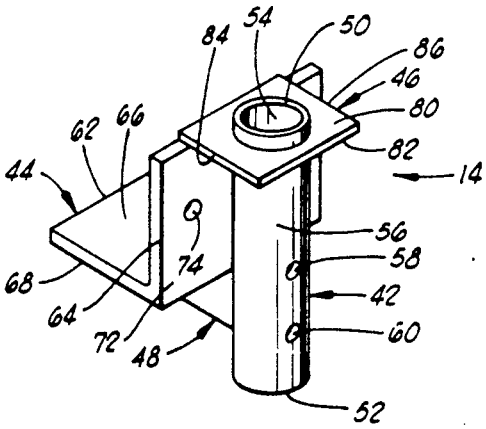
FIG. 2 shows a support collar constructed in accordance with the present invention.

The support collar 14, more clearly shown in FIG. 2, comprises a tubular section, generally designated by the numeral 42; a support member, generally designated by the numeral 44; a lifting head stand, generally designated by the numeral 46; and a strut, generally designated by the numeral 48.

The tubular section 42 comprises an upper end 50, a lower end 52, a preferably annular opening 54 from the upper end 50 through the lower end 52 which is slightly larger than the support shaft 16, and an annular outer periphery 56. At least one aperture, and preferably two apertures 58 and 60, from the outer periphery 56 to the opening 54 are positioned on the tubular section 42, preferably opposite the position of the support member 44, to secure the tubular section 42 to the support shaft 16, as described hereafter. The tubular section 42 may be any length that will permit the support collar 14 to function as described herein. Generally, a length of 42 inches has been found to be sufficient.

A support member 44 comprises a shelf portion 62 and a rising portion 64 which are preferably about at a right angle to each other. The shelf portion 62 is disposable under a structure, and comprises an upper surface 66 and a lower surface 68. The shelf portion 62 may be any size that adequately supports the structure 12 as described hereafter. Generally, about 8 inches by about 10 inches has been found to be adequate for the shelf portion 62.

The rising portion 64 is sized to be secured to the tubular section 42, preferably by welding, and comprises a front portion 70 and a back portion 72. Apertures 74 and 76 from the back portion 72 through the front portion 70 are positioned on either side of the tubular section 42 for securing the support collar 14 to the structure 12. Preferably, anchor bolts 78 are disposed in apertures 74 and 76, and received in the structure 12.

A strut 48 is secured to the tubular section 42 and the lower surface 68 of the support member 44 (preferably in about the middle of the lower surface 68). The strut 48 may be of any size or shape, or be constructed from any material which will support the support member 44 in operation.

The lifting head stand 46 comprises an upper surface 80 and a lower surface 82, with an opening (not shown) therethrough sized to receive the tubular section 42, and a first end 84 and a second end 86. The lifting head stand 46 is telescoped over and secured to about the upper end 50 of the tubular section 42, preferably by welding. The lifting head stand 4 is sized to slidingly receive the lifting head, generally designated by the numeral 88, as described hereafter.

Figure 6:
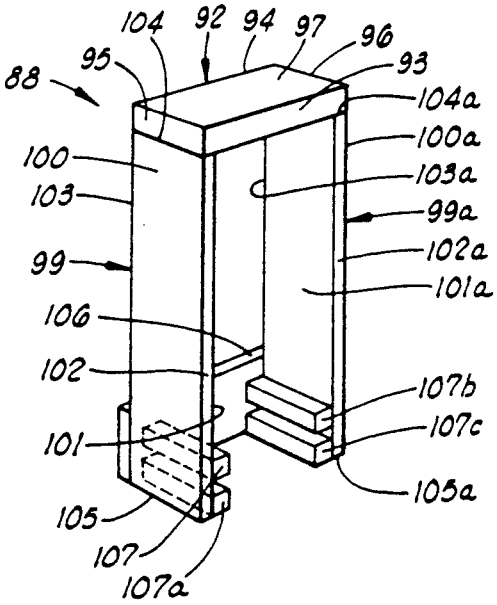
FIG. 6 shows a perspective view of a lifting head constructed in accordance with the present invention.
Figure 10:
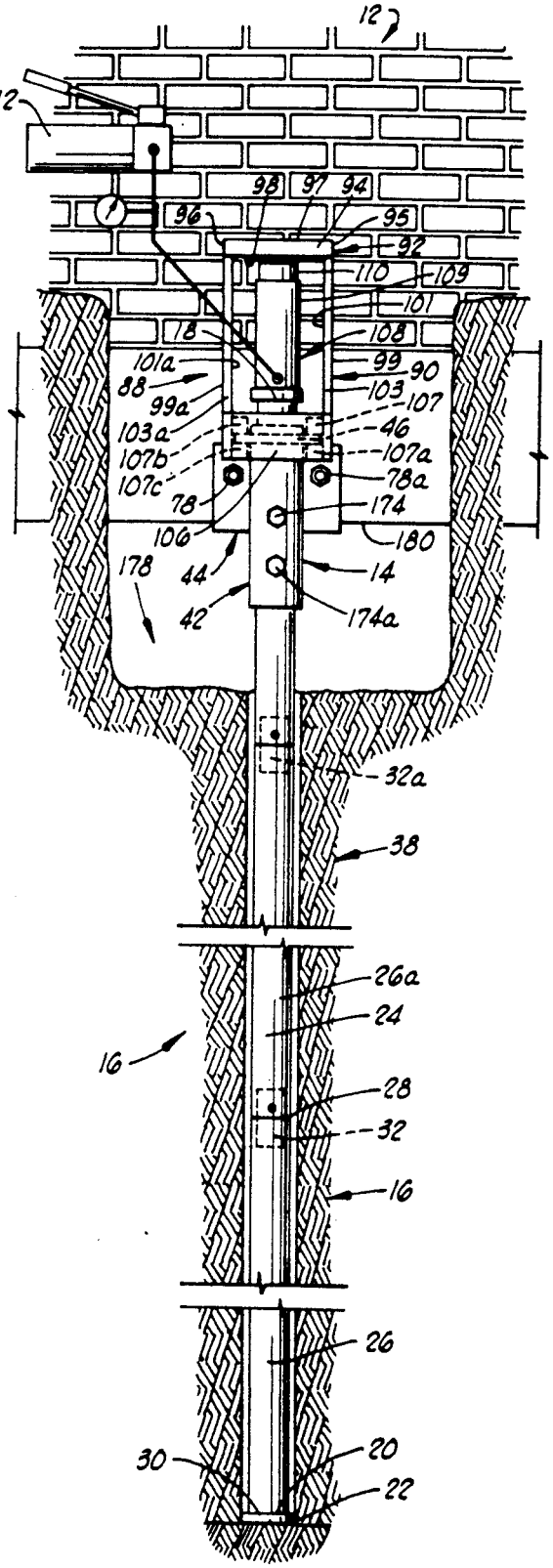
FIG. 10 shows a back elevational view of the support shaft and the support collar shown in FIG. 9 with a lifting head positioned on the support collar and the support collar secured to the support shaft, in accordance with the present invention.

The lifting head 88, as shown in FIGS. 6 and 10, comprises a housing 90 comprising a top plate 92 comprising a first end 93 opposite a second end 94, a third end 95 opposite a fourth end 96, and an upper surface 97 opposite a lower surface 98. The lifting head 88 also comprises a first leg 99 and a second leg 99*a* respectively comprising outer surfaces 100 and 100*a*, inner surfaces 101 and 101*a*, first ends 102 and 102*a* opposite second ends 103 and 103*a*, and third ends 104 and 104*a* opposite fourth ends 105 and 105*a*. The third end 95 of the top plate 92 is secured to the third end 104 of the first leg 99, and the fourth end 96 of the top plate 92 is secured to the third end 104*a* of the second leg 99*a*.

A brace 106 interconnects and is secured to the second ends 103 and 103*a* of the legs 99 and 99*a*, preferably near the fourth ends 105 and 105*a* of the legs 99 and 99*a*. The brace 106 may be of any size that will function to strengthen the lifting head 88.

The lifting head 88 is removably securable to the support collar 14 and functions as a frame to support a lifting jack which lifts the support collar 14 (and thus the structure) to the desired height. "Supporting the jack" means that the jack is positioned in a manner to function as described herein. Preferably, the lifting head 88 is not bolted to the support collar 14 since the bolting procedure can prove awkward and dangerous to the operators due to the weight of the lifting heading and the lifting jack contained therein. Also, bolting does not always provide the best method of securable contact between the support collar 1 and the lifting head 88, since the bolted area may permit a play between the lifting head 88 and the support collar 14. Since only a fraction of an inch can be significant in lifting and supporting a structure at the desired elevation, it is preferable to secure the lifting head 88 to the support collar in a manner which permits no play there between. A preferred method of securing the lifting head 88 to the support collar 14 is to secure slide bars 107, 107*a*, 107*b* and 107*c* to the inner surfaces 101 and 101*a* of the legs 99 and 99*a*, preferably near the fourth ends 105 and 105*a* of the lifting head 88. The lifting head 88 is then slidingly received between the slide bars 107, 107*a*, 107*b* & 107*c*.

The slide bars 107–107*c* are preferably bars of steel welded to the leg inner surfaces 101 and 101*a* which are about the length of the distance between the leg first ends 102 and 102*a* to the leg second ends 103 and 103*a*. The bars 107–107*c* are any width that will function to hold the lifting head stand 46 as described herein. Preferably the brace 106 is secured to the leg second ends 103 and 103*a* near the slide bars 107–107*c* such that the lifting head stand 46 cannot slide past the second ends 103 and 103*a* of legs 99 and 99*a*.

Referring to FIG. 6, slide bars 107 and 107*a* are secured in a parallel arrangement to the inner surface 99; similarly, slide bars 107*b* and 107*c* are secured in parallel arrangement to the inner surface 99*a*. The distances between 107 and 107*a*, and 107*b* and 107*c* are about the same, and are sufficient to slidingly receive respectively lifting head stand first end 84 and lifting head stand second end 86. Slide bars 107 and 107*b* are about in the same plane, as are slide bars 107*a* and 107*c*, such that the lifting head stand 46 is received in the lifting head 88 in a level plane. Each component of the lifting head 88 may be any shape or size, or be made from any material which will permit the lifting head 88 to function a described herein.

Referring to FIG. 10, when the lifting head 88 is secured to the lifting head stand 46, the upper end 18 of the support shaft 16 is disposed a distance into the lifting head housing 90. A lifting jack 108 comprising a jack cylinder 109, a piston (not shown) and a piston rod 110, such as 25 Ton Jack made by Enerpac of Butler, Wisconsin, is positioned inside the lifting head housing 90 preferably so that the piston rod 110 contacts the lower surface 98 of the top plate 92, and the jack cylinder 109 contacts the upper end 18 of the support shaft 16. Jack activator 112 such as Powerpack made by Enerpac of Butler, Wisconsin, activates the lifting jack 108.

When the lifting jack 108 is activated, the lifting head 88 is lifted which pulls up the secured support collar 14 and the structure 12 under which a portion of the support collar 14 is disposed. The support collar 14 may then be anchored to the support shaft 16 by bolts 174 and 174*a*, and the lifting head 88 removed.

Figure 3:
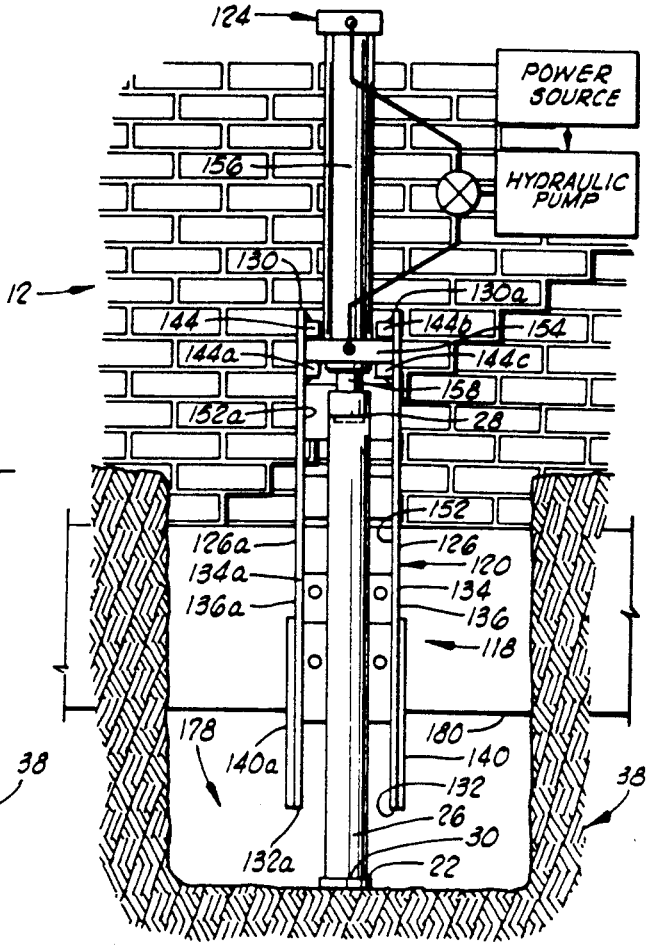
FIG. 3 shows a back elevational view of a jackstand of the present invention secured to a structure with a jack positioned on the jackstand to drive a support shaft into the ground.
Figure 4:
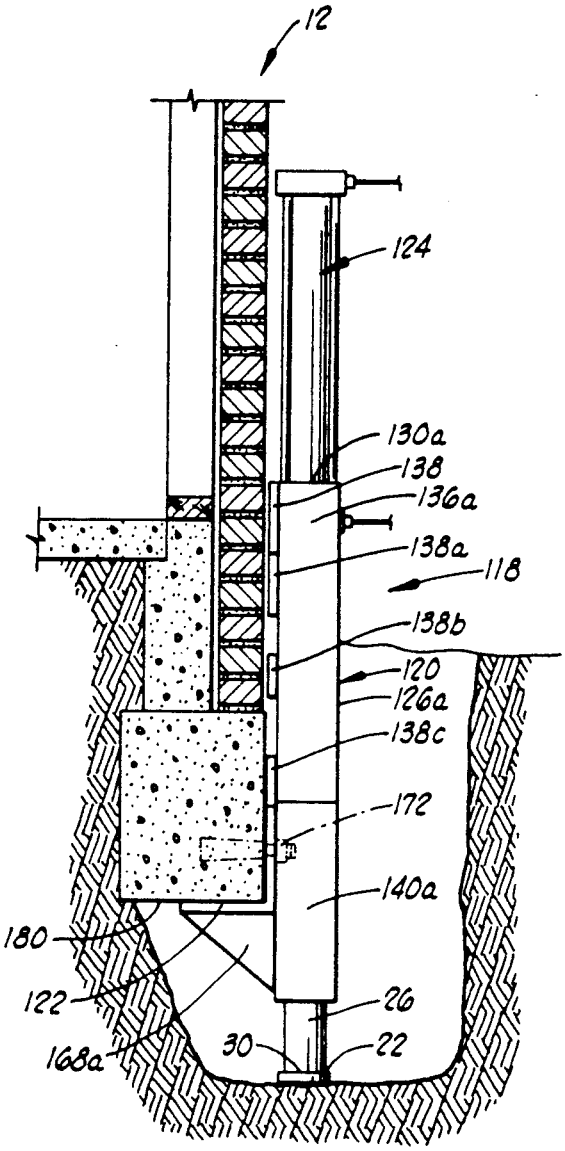
FIG. 4 shows a side elevational view of the apparatus in FIG. 3.
Figure 5:
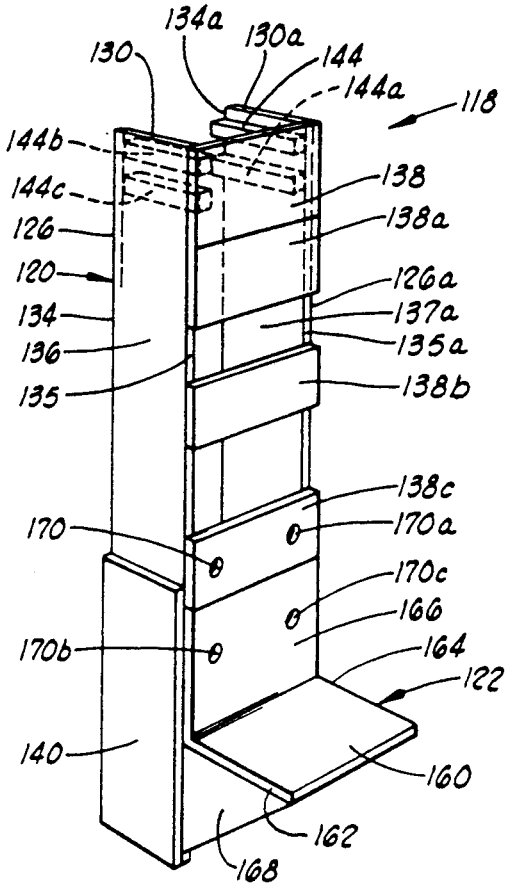
FIG. 5 shows a perspective view of a jackstand constructed in accordance with the present invention.

Referring to FIGS. 3–5, the present invention also comprises a jackstand, generally designated by the numeral 118. The jackstand 118 comprises a frame 120 removably securable to the structure 12, a support ledge 122 permanently secured to the frame 120, and an area to support the jack 124 so that the jack 124 can drive the support shaft 16 into the ground 38.

The frame 120 of the jackstand 118 comprises two sidewalls 126 and 126*a* of about equal dimensions. Each sidewall 126 and 126*a* respectively comprises an upper end 130 and 130*a*, a lower end 132 and 132*a*, a first end 134 and 134*a* opposite a second end 135 and 135*a*, and an outer surface 136 and 136*a* opposite an inner surface 137 and 137*a*. Preferably a plurality of braces 138, 138*a*, 138*b* and 138*c* interconnect the second ends 135 and 135*a* of the sidewalls 126 and 126*a*. The braces 138, 138*a*, 138*b* and 138*c* are sized to secure the sidewalls 126 and 126*a* together and strengthen the frame 120 during operation of the jack 124.

Preferably reinforcement legs 140 and 140*a* are secured to the sidewalls 126 and 126 near the lower ends 132 and 132*a* thereof preferably to outer surfaces 136 and 136*a*. These legs 140 and 140*a* may be of any size which serve to strengthen the frame 120.

A jack 124 is supported on the frame 120. In a preferred embodiment, the jack 124 is supported on the frame 120 near the upper ends 130 and 130*a* of the sidewalls 126 and 126*a*. Preferably jackstand bars 144, 144*a*, 144*b* and 144*c* are secured to the frame 120 to support the jack 124. Each bar 144, 144*a*, 144*b* and 144*c* is about as long as the distance between each first end 134 and 134*a* and each second end 135 and 135*a*. The bars 144, 144*a*, 144*b* and 144*c* may be any width that are capable of supporting the jack 124 in operation.

Jackstand bars 144 and 144*a* are secured in a parallel arrangement, as shown in FIG. 5, to the inner surface 137*a* of sidewall 126*a*; likewise, jackstand bars 144*b* and 144*c* are secured in a parallel arrangement to the inner surface 137 of sidewall 126. The space between the bars on each sidewall 126 and 126*a* is sufficient to receive a portion of the jack 124, as described hereafter. Jackstand bars 144 and 144*b* are in a level plane, as are jackstand bars 144*a* and 144*c*, such that a jack 124 may be supported in a level fashion.

Any jack 124 may be used in accordance with the present invention which can be operatively supported on the jackstand 118 to function as described herein. Preferably the jack 124 comprises a hydraulic cylinder 156, a piston (not shown) connected to a piston rod 158, and a collar 159 disposed on the cylinder 156 which is slidingly received between the jackstand bars 144 and 144*a*, 144*b* and 144*c*.

As previously described, the jackstand 118 further comprises a support ledge 122 secured to second ends 135 and 135*a* of the sidewalls 126 and 126*a* preferably near the lower ends 132 and 132*a* of the sidewalls 126 and 126*a*. The support ledge 122 comprises a ledge portion 160, having a first end 162 and a second end 164, connected to an upright portion 166.

The support portion 160 and the upright portion 166 are at about a right angle to each other. The upright portion 166 is secured to the sidewall second ends 135 and 135*a* permitting the ledge portion 160 to extend a distance from the sidewalls 126 and 126*a*. The ledge portion 160 is sized to remain beneath the structure 12 when disposed thereunder during the operation of the jack 126, as more fully described hereafter. The upright portion 166 may be of any size or shape that aids in securing the ledge portion 160 to the frame 120.

Ledge strut 168 is secured to the first end 162 of the ledge portion 160 and the second end 135 of the sidewall 126. Likewise, ledge strut 168*a* is secured to the second end 164 of the ledge portion 160 and the second end 135*a* of sidewall 126*a*. Any size or shape of ledge strut 168 and 168*a* may be used that will sufficiently support the ledge portion 160. The upright portion 166 has apertures 170, 170*a*, 170*b* and 170*c* to receive preferably at least two bolts 172 and 172*a* to secure the frame 120 to the structure 12.

The dimensions and materials of construction of the jackstand 118 may vary with the jack 124 used, the sections 26 of support shaft 16 used, and the type of structure 12 to be lifted and supported. Generally, steel has been found to a satisfactory material from which to construct the jackstand 118.

In operation, a hole, generally designated by the numeral 178, is dug in the ground 38 or any other surface on which the structure 12 is disposed. The hole 178 is of sufficient size to expose the footing 180 or other area of the structure 12 to be supported, and in which to place the jackstand 118 of the present invention, as shown in FIGS. 3 and 4. The jackstand 118 with the jack 124 is disposed in the hole such that the ledge portion 180 is underneath the footing 180, as shown in FIG. 4. The jackstand 118 is secured to the footing by bolts 172 and 172*a* through any of apertures 170, 170*a*, 170*b* or 170*c*. A section 26 having a friction collar 22 is disposed under the piston rod 158 of the jack 124, as shown in FIG. 3.

Figure 7:
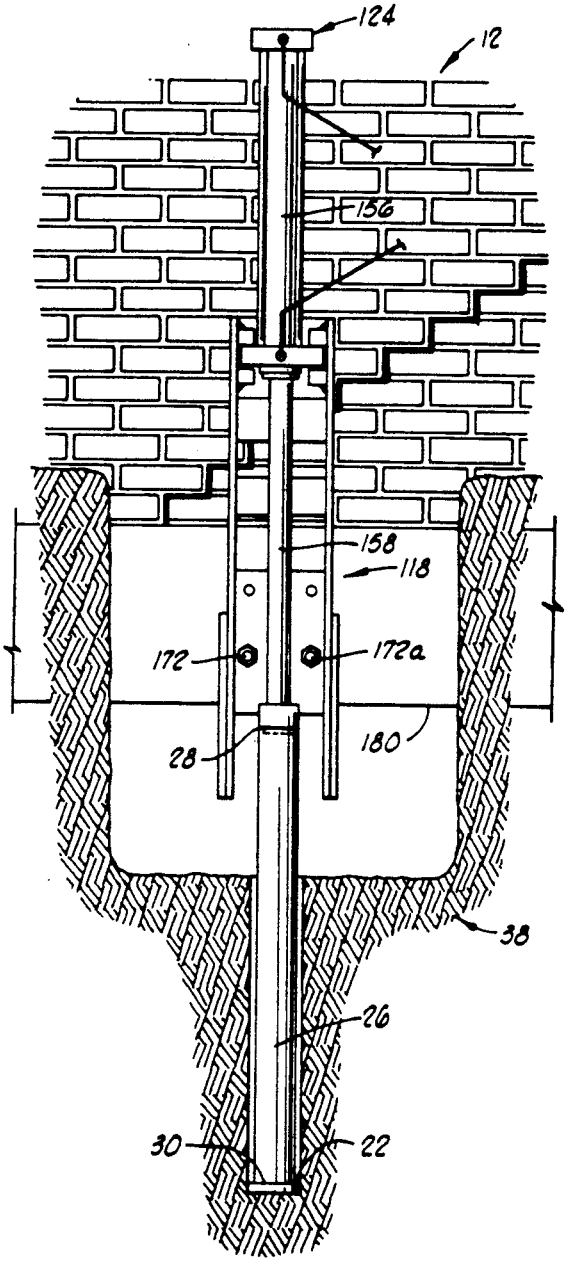
FIG. 7 shows a back elevational view of the apparatus in FIG. 3 with the jack driving a support shaft section into the ground.
Figure 8:
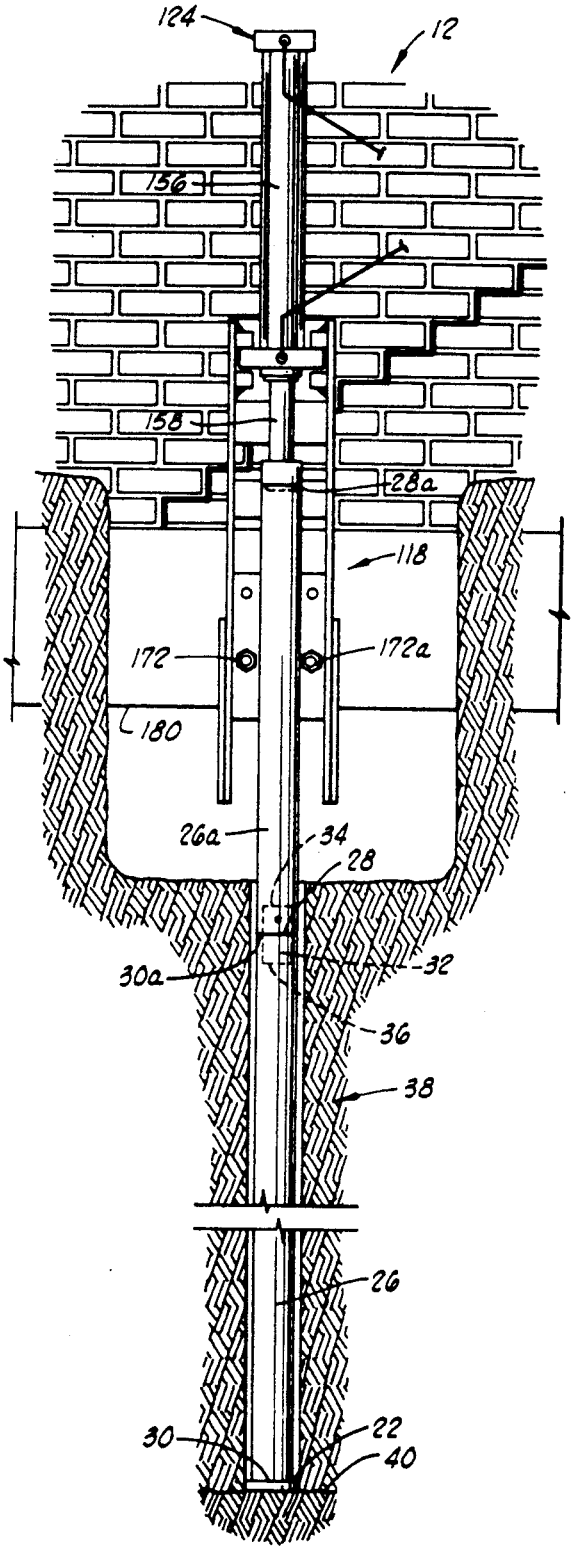
FIG. 8 shows a back elevational view of the apparatus shown in FIGS. 3 and 7 with the jack driving additional sections of the support shaft into the ground.
Figure 9:
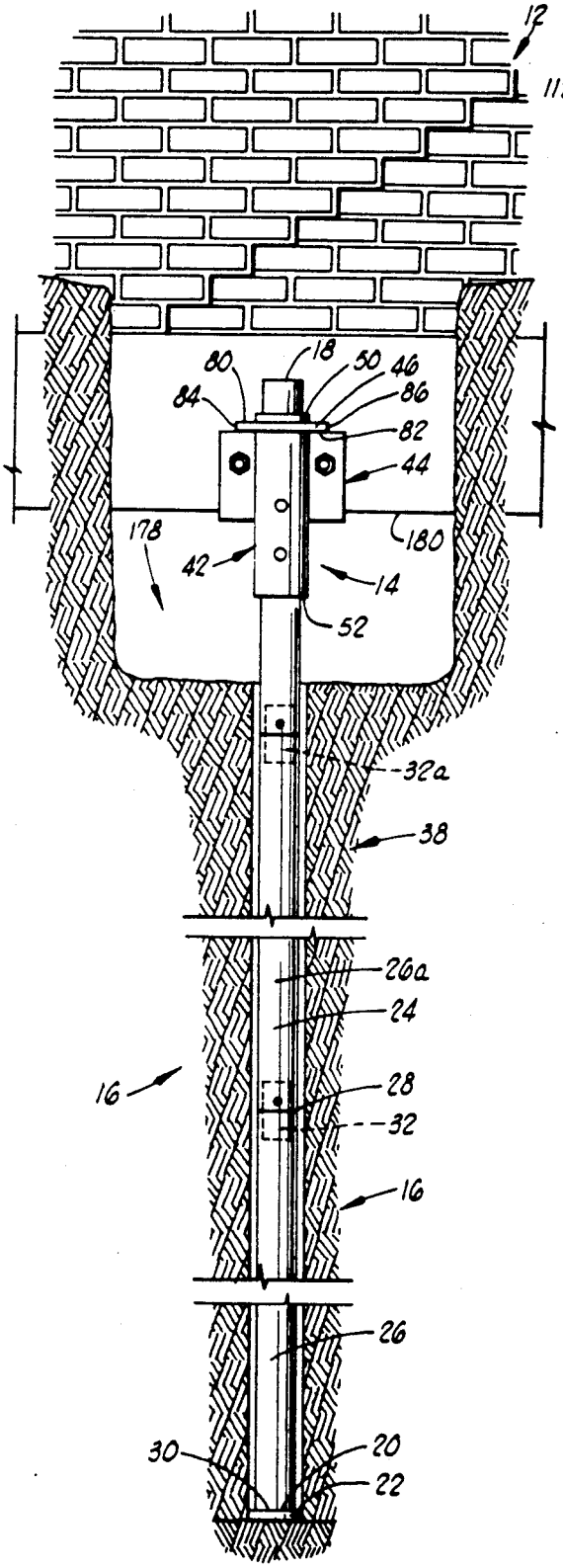
FIG. 9 shows a back elevational view of the support shaft driven into the ground with a support collar positioned on the upper portion of the support shaft and secured to the structure, in accordance with the present invention.

The jack 124 is actuated which drives the section 26 into the ground 38 as shown in FIG. 7. If the stroke of the piston rod 158 does not drive the section 26 completely into the ground 38, a short section (not shown) may be positioned under the elevated piston rod 158 and on top of the upper end 28 of section 26 to push the section 26 further into the ground 38. The lower end 30*a* of section 26*a* is positioned over the coupler 32 secured to the upper end 28 of section 26. The upper end 28*a* of section 26*a* is positioned under the elevated piston rod 158, and the jack 126 actuated to push section 26*a* into the ground, as shown in FIG. 8. This process is repeated until load strata 40 is reached by the friction collar 22 which may be determined by a hydraulic gauge showing P.S.I. measurements (about 8lbs/p.s.i).

When load strata 40 is reached, the jackstand 118 is removed. The tubular section 42 of the support collar 14 is telescoped over the upper end 18 of the support shaft 16, and the shelf portion 62 disposed under the footing 180. The support shaft 16 may need to be cut so that the support shaft 16 does not extend too far beyond the support collar 14. In this position, the support collar 14 is disposed on the "upper end portion" of the support shaft, meaning that the tubular section 42 is telescoped over the support shaft upper end 18 with the support shaft upper end 18 extending a distance past the tubular section upper end 50 sufficient for the lifting head jack 108 to operatively contact as described herein.

The support collar 14 is then bolted to the footing 180 preferably with anchor bolts 78 and 78*a* through apertures 74 and 76. The support collar bolts 78 and 78*a* preferably do not use the same holes in the footing as used by the jackstand bolts 172 and 172*a*.

The lifting head 88 is secured to the support collar 14. The lifting head 88 slides onto the lifting head stand 46 of the support collar 14 preferably with the lifting jack 108 positioned therein: the lifting head stand first end 84 and the lifting head stand second end 86 are received respectively between lifting head slide bars 107*b* and 107*c*, and 107 and 107*a*. The lifting jack cylinder 109 contacts the upper end 18 of the support shaft 16, and the lifting jack piston rod 110 contacts the top plate lower surface 98.

When the lifting jack 108 is actuated, the lifting jack piston rod 110 extends from the cylinder 10 which lifts the lifting head 88. Since the lifting head 88 is secured to the support collar 14, the support collar 14 is elevated which in turn elevates the structure 12.

The support collar 14 is next secured to the support shaft 16 preferably by drilling apertures through the tubular section 58 and 60 and the support shaft 16. More preferably, these apertures 58 and 60 are threaded to threadingly engage threaded bolts 174 and 174*a*.

The present invention also contemplates using a plurality of support shafts 16, on which the support collars 14 of the present invention are disposed under a single structure 12 as described herein. A manifold (not shown) may be used to measure and distribute the appropriate amount of compressed air to the lifting jacks 108 in order to simultaneously lift the structure 12 to the same elevation at the points where the plurality of support shafts and support collars are located.

When the structure 12 has been lifted and supported sufficiently to correct cracks in the structure 12 and/or level the structure as previously described, the hole 178 is filled leaving no observable trace of the present invention.

The present invention also contemplates relifting a structure that is supported with the support collar 14 on a support shaft 16 of the present invention. If the structure 12 resettles, the filled hole is excavated, and the lifting head 88 secured to the support collar 14 as previously described. The bolts 174 and 174*a* are removed, and the structure raised as previously described. New aperatures are drilled into the support shaft 16 and, if necessary into the tubular section 42 for the placement of new bolts at the newly elevated position.

Changes may be made in the combination and arrangement of parts or elements or in the steps of the methods as herefore set forth in the specification and shown in the drawings without departing from the spirit and scope of the invention as defined in the following claims:

What is claimed is:

1. A support collar for supporting a structure, disposable on the upper portion of a support shaft and capable of securing a lifting head thereto, the lifting head comprising a housing capable of supporting a lifting jack, the housing comprising a top plate disposed between a first leg and a second leg, and horizontal slide bars secured to the legs capable of slidingly receiving, and thereby securing, the lifting head stand, comprising:

a tubular section having an upper end and a lower end telescopable over and securable to the upper end portion of the support shaft;

a support member secured to the tubular section disposable under the structure; and a lifting head stand secured about the upper end of the tubular section capable of being slidingly receiving and thereby secured to the lifting head.

2. A lifting head for use with a lifting jack and a support collar disposable on a support shaft for lifting a structure, wherein the support collar comprises a tubular section telescopable over and securable to a support shaft, a support member disposable under the structure and secured to the tubular section, and a lifting head stand secured to the upper end of the tubular section, comprising:

a housing capable of supporting the lifting jack comprising a top plate disposed between a first leg and a second leg; and horizontal slide bars means secured to the first leg and the second leg for receiving the lifting head stand and being capable of slidingly receiving and thereby securing the lifting head to the support collar.

3. An apparatus for use with a lifting jack for lifting a structure, the apparatus disposable on an upper portion of a support shaft, comprising:

a support collar, comprising: a tubular section telescopable over and securable to the upper end of the support shaft;

a. support member secured to the tubular section disposable under the structure; and a lifting head stand secured about the upper end of the tubular section capable of securing a lifting head thereto, the lifting head comprising a housing capable of supporting a lifting jack, the housing comprising a top plate disposed between a first leg and a second leg and horizontal slide bars secured to the legs capable of slidingly receiving and thereby securing the lifting head stand thereto.

4. A method to lift and support a structure on a support shaft, comprising:

driving the support shaft into the ground for a distance sufficient to support the structure;

disposing a support collar on the upper end portion of the support shaft after the support shaft is driven into the ground, a portion of the support collar disposed under the structure, wherein the support collar comprises:

a tubular section telescopable over and securable to the upper end portion of the support shaft;

a support member secured to the tubular section disposable under the structure; and a lifting head stand secured to the upper end of the tubular section, the upper end of the shaft extending a distance beyond the support collar; and securing the support collar to the structure;

lifting the support collar thereby lifting the structure, comprising:

securing a lifting head on the lifting head stand, the lifting head comprising:

a housing capable of supporting a lifting jack; and means for securing the lifting head to the lifting head stand;

disposing a lifting jack in the lifting head so that the lifting jack engages the upper end of the shaft; and activating the lifting jack thereby lifting the support collar and the structure; and securing the support collar to the support shaft.

5. The method of claim 4 in which driving the support shaft into the ground comprises:

providing a jack capable of driving the support shaft into the ground;

securing a jackstand to the structure, the jackstand comprising:

a frame securable to the structure;

means for supporting the jack; and a support ledge permanently secured to the frame, disposable under the structure, the support ledge disposed under the structure; and driving the support shaft into the ground with the jack.

6. A method for lifting and supporting a structure on a support shaft in which the support shaft has been driven into the ground a distance sufficient to support the structure, comprising:

disposing a support collar on the upper end portion of the support shaft after the support shaft is driven into the ground, a portion of the support collar disposed under the structure wherein the support collar comprises:

a tubular section telescopable over and securable to the upper end portion of the support shaft;

a support member secured to the tubular section disposable under the structure; and a lifting head stand secured to the upper end of the tubular section, the upper end of the shaft extending a distance beyond the support collar;

securing the support collar to the support structure;

lifting the support collar thereby lifting the structure, comprising:

securing a lifting head on the lifting head stand, the lifting head comprising:

a housing capable of supporting a lifting jack; and means for removable securing the lifting head to the lifting head stand;

disposing a lifting jack in the lifting head so that the lifting jack engages the upper end of the shaft; and activating the lifting jack thereby lifting the support collar and the structure; and securing the support collar to the support shaft.

* * * * *

UNITED STATES PATENT AND TRADEMARK OFFICE
CERTIFICATE OF CORRECTION

PATENT NO. : 5,013,190

DATED : May 7, 1991

INVENTOR(S) : Paul W. Green

It is certified that error appears in the above-identified patent and that said Letters Patent is hereby corrected as shown below:

Col. 3, line 7, please delete the numeral "4" and substitute therefor the numeral -- 40 --.

Col. 3, line 58, please delete the numeral "4" and substitute therefor the numeral -- 46 --.

Col. 4, line 22, please delete the numeral "1" and substitute therefor the numeral -- 14 --.

Col. 7, line 17, please delete the numeral "10" and substitute therefor the numeral "109".

Signed and Sealed this

Twenty-seventh Day of April, 1993

*Attest:*

MICHAEL K. KIRK

*Attesting Officer*

*Acting Commissioner of Patents and Trademarks*